US005899301A

United States Patent [19]

Aulanko et al.

[11] Patent Number: 5,899,301

[45] Date of Patent: May 4, 1999

[54] ELEVATOR MACHINERY MOUNTED ON A GUIDE RAIL AND ITS INSTALLATION

[75] Inventors: Esko Aulanko, Kerava; Jorma Mustalahti; Harri Hakala, both of Hyvinkää, all of Finland

[73] Assignee: KONE Oy, Helsinki, Finland

[21] Appl. No.: 08/944,294

[22] Filed: Oct. 6, 1997

Related U.S. Application Data

[63] Continuation of application No. 08/476,316, Jun. 7, 1995, abandoned, which is a continuation-in-part of application No. 08/178,136, Dec. 30, 1993, Pat. No. 5,435,417.

[30] Foreign Application Priority Data

Jun. 23, 1994 [FI] Finland ..... 943043

[51] Int. Cl.[6] ..... B66B 11/08

[52] U.S. Cl. ..... 187/266; 187/406; 187/254

[58] Field of Search ..... 187/266, 254, 187/250, 292, 406; 310/91, 51, 268

[56] References Cited

U.S. PATENT DOCUMENTS

| | | | |
|---|---|---|---|
| 2,088,690 | 8/1937 | Crispen | 187/254 |
| 3,101,130 | 8/1963 | Bianca | 187/266 |
| 3,500,083 | 3/1970 | Dochterman | 310/51 |
| 4,664,230 | 5/1987 | Olsen . | |
| 4,739,969 | 4/1988 | Eckersley et al. . | |
| 4,960,186 | 10/1990 | Honda | 187/254 |
| 5,018,603 | 5/1991 | Ito | 187/266 |
| 5,144,183 | 9/1992 | Farrenkopf | 310/268 |
| 5,475,274 | 12/1995 | Katakura | 310/51 |
| 5,589,722 | 12/1996 | Sakaguchi et al. | 310/180 |

FOREIGN PATENT DOCUMENTS

| | | |
|---|---|---|
| 51802 | of 1976 | Finland . |
| 1575459 | of 1969 | France . |
| 62-230587 | 10/1987 | Japan . |
| 4-50297 | of 1992 | Japan . |

OTHER PUBLICATIONS

"PC Brushless Motor and Control Circuit" Table of contents and p. 42, 43, and 204, Nov. 1994.

*Primary Examiner*—Kenneth Noland
*Assistant Examiner*—Khoi H. Tran
*Attorney, Agent, or Firm*—Birch, Stewart, Kolasch & Birch, LLP

[57] ABSTRACT

An elevator machinery (1) with a disc type motor is mounted on one of the guide rails (6) of the elevator car or counterweight. The guide rail (6) constitutes a part adding to the mechanical strength of the elevator machinery. The vertical forces applied to the traction sheave (4) by the elevator ropes are passed to the guide rail (6) via the rolling center of a bearing. The elevator machinery is provided with a damping system to absorb vibrations and oscillations. The elevator machinery (1) of the invention is light in weight, needs only a small space when mounted and is inexpensive to manufacture.

82 Claims, 6 Drawing Sheets

ELEVATOR MACHINERY MOUNTED ON A GUIDE RAIL AND ITS INSTALLATION

This application is a continuation of application Ser. No. 08/476,316 filed on Jun. 7, 1995, now abandoned, which was a CIP of 08/178,136, filed Dec. 30, 1993, now U.S. Pat. No. 5,435,417.

FIELD OF THE INVENTION

The present invention relates to elevator machinery for and elevator.

DESCRIPTION OF THE BACKGROUND ART

Depending on the placement of an elevator machinery, its physical dimensions have an influence on the size of the elevator shaft and/or building. When the elevator machinery is placed in the elevator shaft, beside the shaft or in a machine room, the properties and dimensions of the machinery have a significance in respect of the space required.

A conventional elevator machinery has a motor, a gear system and a traction sheave as separate parts. A conventional elevator machinery is well suited for installation in a machine room, because there is a sufficient space reserved for it in the machine room. Solutions are also known in which such a machinery is placed in the counterweight or beside the shaft.

An elevator machinery can also have a gearless construction, based e.g. on a disc-type motor as presented e.g. in FIG. 8 of U.S. Pat. No. 5,018,603. The motors presented in the specification are clearly more compact and also flatter in the axial direction of the motor shaft than conventional geared elevator machineries. However, the machineries described in the specification are clearly designed for installation in an elevator machine room.

When a geared or gearless elevator machinery of known construction is placed in the elevator shaft, their space requirement becomes obvious as they always need an extra space.

SUMMARY OF THE INVENTION

The object of the present invention is to achieve a new solution for the placement of an elevator machinery based on a disc-type motor in which the space required by the machinery when installed in the elevator shaft is as small as possible. The elevator machinery of the invention is characterized by said machinery comprising at least an elevator motor and a traction sheave driving elevator ropes, said elevator motor having a discoidal stator, a discoidal rotor, a motor shaft and at least one bearing between the rotor and the stator, the elevator machinery being mounted on a guide rail for the elevator or counterweight.

The invention provides the advantage that the elevator machinery can be installed in the elevator shaft without substantially requiring any extra space in the shaft. The elevator machinery is mounted on an elevator or counterweight guide rail which is needed in the shaft anyway, and the forces caused by the elevator ropes are transmitted directly to the guide rail. Since the guide rail is designed to receive the large vertical forces generated by the action of the safety gears of the elevator, the guide rails need is not be dimensioned separately to permit the installation of the machinery.

An embodiment of the invention has the advantage that the elevator guide rail is used as a structural part of the elevator machinery to increase its strength. In this case, the elevator machinery itself can have a lighter construction and is therefore cheaper to manufacture.

In another embodiment, the vertical forces generated by the elevator ropes are passed via the rolling center of one of the bearings of the machinery to the guide rail. This provides the advantage that no reinforcement is required in that part of the guide rail to which the elevator machinery is attached to increase the rigidity of the rail, because the machinery permits some bending of the guide rail.

In yet another embodiment, the machinery is provided with means for damping vibrations, placed between the elevator machinery and the guide rail. The damping system in this embodiment ensures that bearing noise and the noise and vibrations generated by the elevator ropes in the rope grooves cannot be transmitted to the guide rail and further to the building.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is described by the aid of drawings which are given by way of illustration only, and thus are not limitative of the present invention, and in which.

DESCRIPTION OF THE PREFERRED EMBODIMENTS

Figure 1:
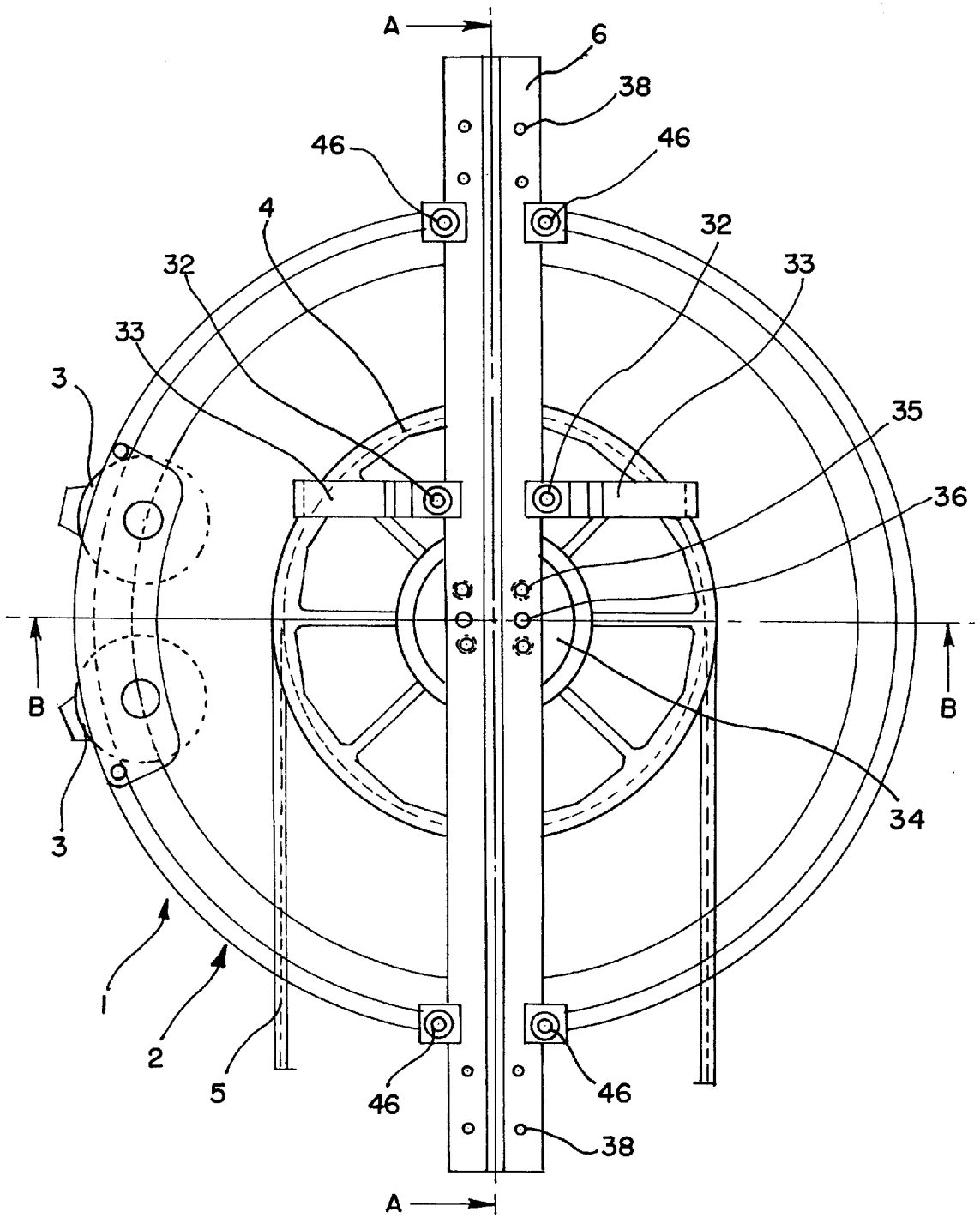
FIG. 1 presents an elevator machinery as defined by the invention, seen from the direction of the motor shaft.

FIG. 1 shows a gearless elevator machinery 1 as provided by the invention, mounted on a guide rail 6. The guide rail may be an elevator guide rail or a counterweight guide rail and the point of attachment of the elevator machinery to the guide rail may be e.g. in the upper or lower part of the shaft. The elevator machinery 1 comprises a disc-type elevator motor 2, a brake 3 and a traction sheave 4. The elevator ropes 5 are passed around the traction sheave 4. The elevator machinery is fixed by the edge of the stator 9 to the elevator guide rail 6 by means of clawlike clamps 46 on opposite sides of the machinery. Moreover, the elevator machinery is fixed by its central part to the guide rail by means of fixing elements 35 and a supporting element 34. The vertical forces of the elevator machinery are passed to the supporting element 34 and further via shear bolts 31 to the guide rail 6. The clawlike clamps keep the machinery in place on the guide rail and prevent it from turning. The fixing element 35 supports the elevator machinery by means of the shear bolts 36 and, together with the clamps 34, prevents the machinery from turning and moving sideways in relation to the guide rail. Furthermore, there is a protecting device 33 attached to the guide rail 6 by means of fixing elements 32 to prevent the elevator ropes 5 from coming off the rope groove 19 of the traction sheave 4.

Figure 2:
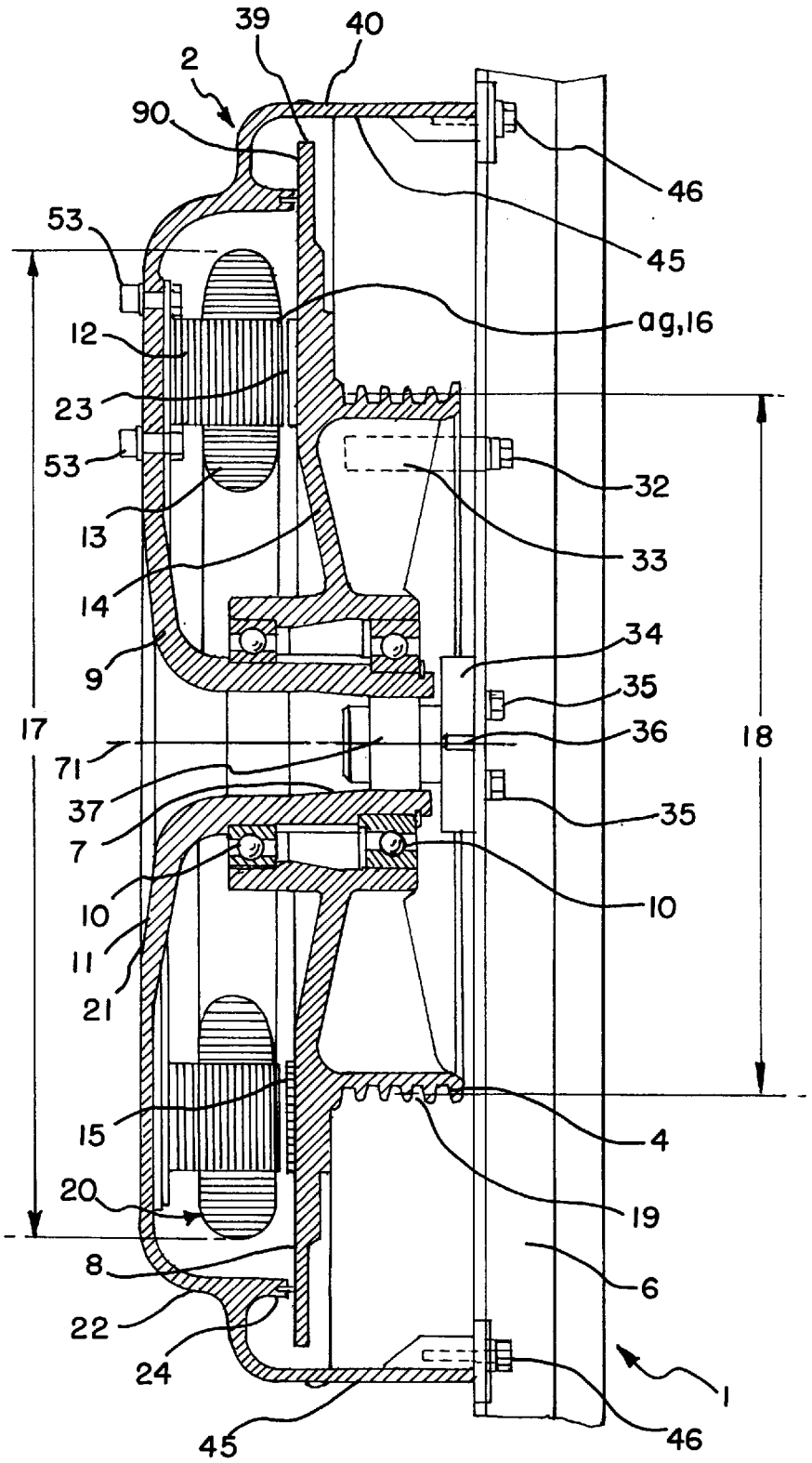
FIG. 2 presents a cross-section of the elevator machinery.

FIG. 2 presents the elevator machinery 1 of FIG. 1 as sectioned along line A—A. The elevator machinery 1 comprises an elevator motor 2, a traction sheave 4 driving the elevator ropes 5 and a brake 3 (shown in FIG. 1). The elevator motor consists of a stator 9, a motor shaft 7 and a rotor 8 and a bearing 10 between the rotor 8 and stator 9. The stator 9 consists of a stator disc 11 formed by an annular stator core packet 12 with a stator winding 13. The stator core packet together with its winding is attached by means of fixing elements 53 to the stator disc 11. The fixing elements are preferably screws. The rotor 8 consists of a rotor disc 14 provided with rotor excitation elements 15 placed opposite to the stator core packet 12. The rotor excitation elements 15 are formed by attaching a number of permanent magnets 23 to the rotor disc 8 in succession so as to form a ringlike circle. The magnetic flux of the rotor flows inside the rotor disc. The portion of the rotor disc lying under the permanent magnets forms part of the magnetic circuit and also contributes to the material strength of the rotor. The permanent magnets may be different in shape and they can be divided into smaller magnets placed side by side or in succession.

Between the permanent magnets 23 and the stator core packet 12 there is an air gap ag which forms a plane 16 essentially perpendicular to the shaft 7. The air gap ag may also have a slightly conical shape (not shown in the figure). In this case, the mid-line of the cone coincides with the mid-line 71 of the shaft 7. The traction sheave 4 and the stator 9 are placed on different sides of the rotor disc 14 in the direction of the shaft 7 of the elevator motor 2.

The elevator motor 2 may be e.g. a synchronous motor or a commutating d.c. motor.

The traction sheave 4 forms an integrated structure with the rotor disc 14, and the shaft 7 is integrated with the stator disc 11, but both could just as well be implemented as separate parts. However, an integrated structure is preferable with regard to manufacturing technology. The elevator machinery is mounted on the guide rail 6 by means of a supporting element 34 fixed to the rail with screws 35. The screws carry the axial (vertical) loads of the elevator machinery. Between the supporting element and the guide rail there are also shear bolts 36 (2 pcs) which receive the vertical loads. The shaft 7 is hollow and the end of the supporting element is inside the hollow shaft. The supporting element is provided with a relatively narrow annular boss 37 of about 10 mm, placed in alignment with the focus of the rope load of the elevator and at the same time with one of the bearings 10. Thus, between supporting elements 38, the elevator machinery is attached to the guide rail by means of clamps 46 holding the machinery horizontally by the stator and by means of supporting element 34 and shear bolts 36 supporting it vertically by its central part, allowing some bending of the guide rail in the region of the narrow boss 37. This arrangement provides the advantage that the guide rail need not be so fixed that it is completely rigid in the region of the machinery, but it suffices for the retainment of the guide rail to fix it to the elevator shaft by means of supporting elements 38 placed on opposite sides of the machinery (FIG. 1) and the guide rail still functions as a structural part reinforcing the elevator machinery. Therefore, the stator of the machinery can be of a light construction, providing an economic advantage.

The stator disc 11 is provided with a cuplike or ring-shaped troughlike cavity 20 formed by a first wall 21 and a second wall 22 joined together, leaving the cavity open on one side. The first wall 21 is attached to the shaft 7. The stator core packet 12 with the stator winding 13 is attached to the first wall by means of fixing elements 53. The second wall 22 is directed towards the rotor disc 14.

The elevator machinery of the invention can also be implemented as an embodiment having a stator disc 11 provided with a cuplike or ring-shaped annular cavity 20 open on one side and formed by a first wall 21 and a second wall 22 joined together, both walls being directed towards the rotor disc 14. The first wall 21 is attached to the shaft 7 by means of bracing ribs and the stator core packet 12 with the stator winding 13 is attached either to the first or the second wall. This second embodiment is suited for elevator motors having a very large diameter. The structure is not shown in the figures because the above description is sufficient for a person skilled in the art.

Mounted between the rotor disc 8 and the second wall 22 directed towards the rotor disc 8 is a sealing 24, which may be a felt gasket, a lap seal or some other type of sealing, e.g. a labyrinth seal. The labyrinth seal may be implemented e.g. by providing the rotor disc 14 with a ridge in the sealing zone 24 and the stator disc with collet-shaped ridges placed in a corresponding location on either side of the first ridge. The sealing prevents detrimental particles from getting into the cavity 20.

The rotor disc is provided with a brake disc 90 for a disc brake, forming an extension of the outer circle of the rotor disc. The brake 3 may also be a shoe brake, in which case the braking surface is the outermost part 39 of the annular brake disc. Thus, the brake disc is substantially an immediate extension of the rotor disc, yet with a narrow annular area for a sealing between the rotor bars and the brake disc.

Moreover, the elevator machinery is provided with an outermost wall 40 which extends over the brake disc and forms a baffle plate shielding the brake plate e.g. from being touched.

Placed between the elevator machinery 1 and the guide rail 6 is a damping means for damping vibrations. The figures do not show the damping means, but it is implemented by placing an element made of a damping material such as rubber between the clamps 46 and the guide rail 6. A corresponding vibration damping element, preferably a tubular one, is also provided between the supporting element 34 and the shaft 7 of the elevator machinery.

Figure 3:
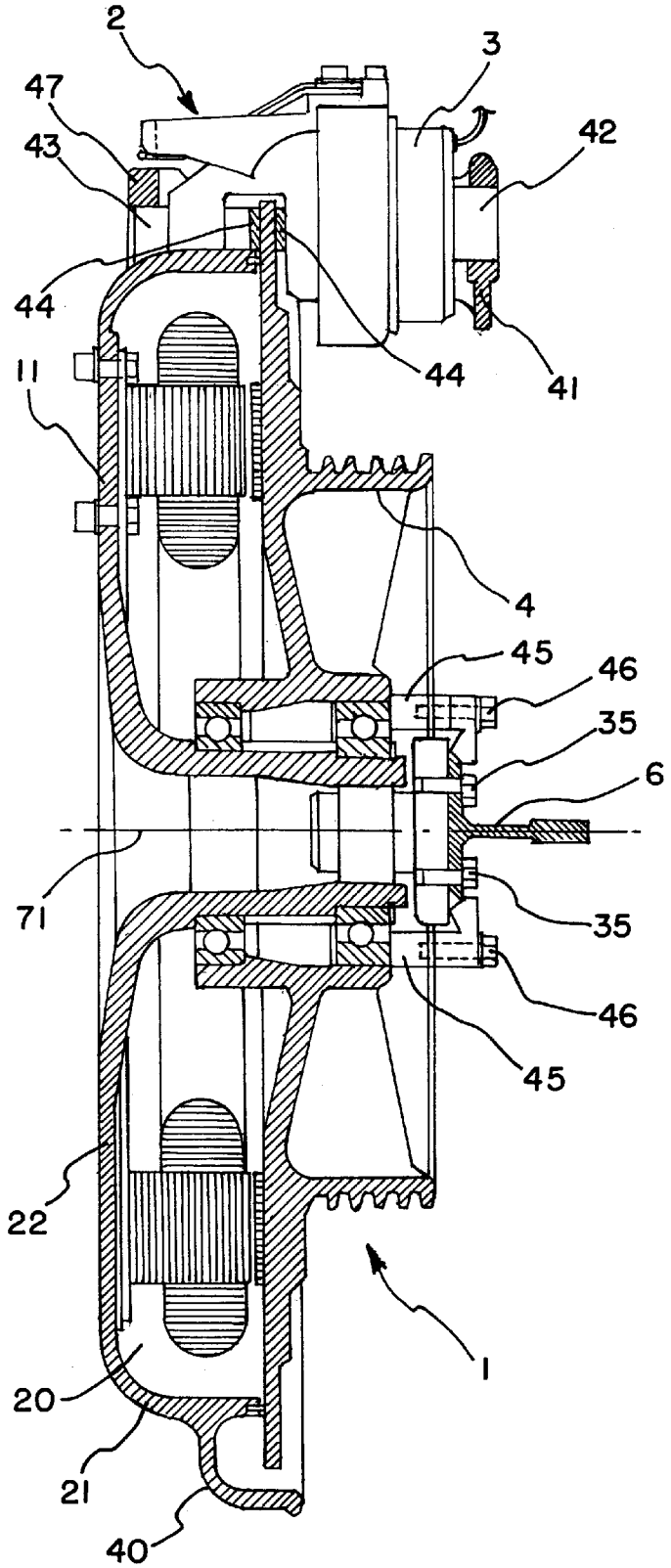
FIG. 3 presents another cross-section of the elevator machinery.

FIG. 3 presents section B—B of FIG. 1. The machinery has two brakes 3 float-mounted by means of fixtures 42 and 43 between mounting brackets 47 forming an extension of the stator disc 11 and a bar 41 attached to the stator disc. The braking surfaces 44 of the brake are placed on either side of the brake disc. The figure also shows the projectures 45 placed on opposite sides of the stator disc in the direction of the guide rail and directed towards the guide rail, by which the elevator machinery is fastened to the guide rail by means of fixing elements 46.

Figure 4:
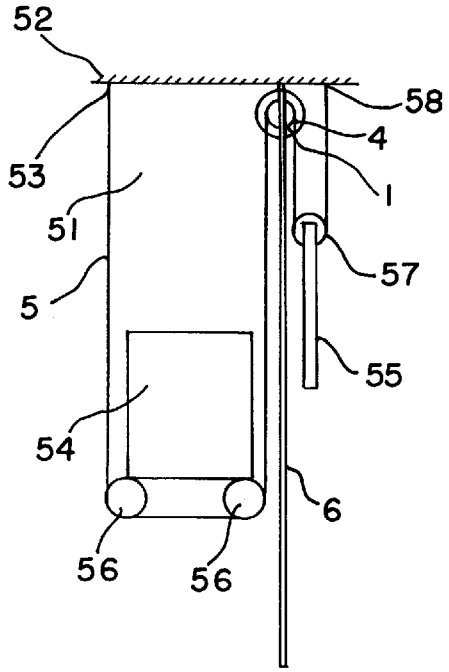
FIG. 4 presents a diagram of a lay-out of the elevator machinery in the elevator shaft.
Figure 5:
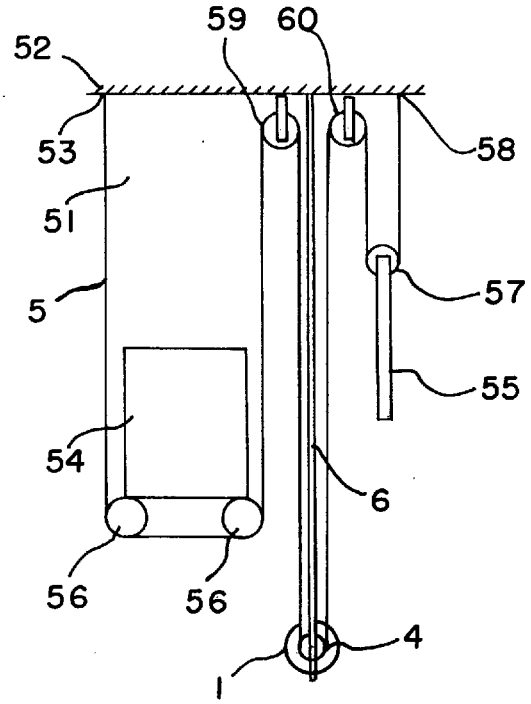
FIG. 5 presents a diagram of another lay-out of the elevator machinery.

FIGS. 4 and 5 present diagrams giving two examples of the placement of the elevator machinery I of the invention on a guide rail 6 in an elevator shaft 51.

In FIG. 4, the elevator machinery is fixed to the top end of the guide rail 6 in the manner illustrated by FIG. 1. The guide rail 6 may be either an elevator guide rail or a counterweight guide rail. One end of the elevator rope 5 is attached to the top 52 of the elevator shaft 51 at point 53, from where the elevator rope is passed via diverting pulleys 56 below the elevator car 54 and up to the traction sheave 4 of the elevator machinery 1, from where it is further passed down to the diverting pulley 57 of the counterweight 55 and then back up to point 58 at the top of the shaft, to which the other end of the elevator rope is fixed.

FIG. 5 illustrates another solution, in which the elevator machinery 1 is fixed to the lower end of the guide rail 6 in the elevator shaft 51. One end of the elevator rope 5 is attached to the top 52 of the elevator shaft 51 at point 53, from where the rope is passed down via diverting pulleys 56 below the elevator car 54 and then over a diverting pulley 59 in the top part of the shaft 51 and back down to the traction sheave 4 of the elevator machinery 1 fixed to the lower end of the guide rail. From here, the rope is passed back up to another diverting pulley 60, then downwards to the diverting pulley 57 of the counterweight 55 and back up to point 58 at the top of the elevator shaft, to which the other end of the elevator rope is fixed.

Figure 6:
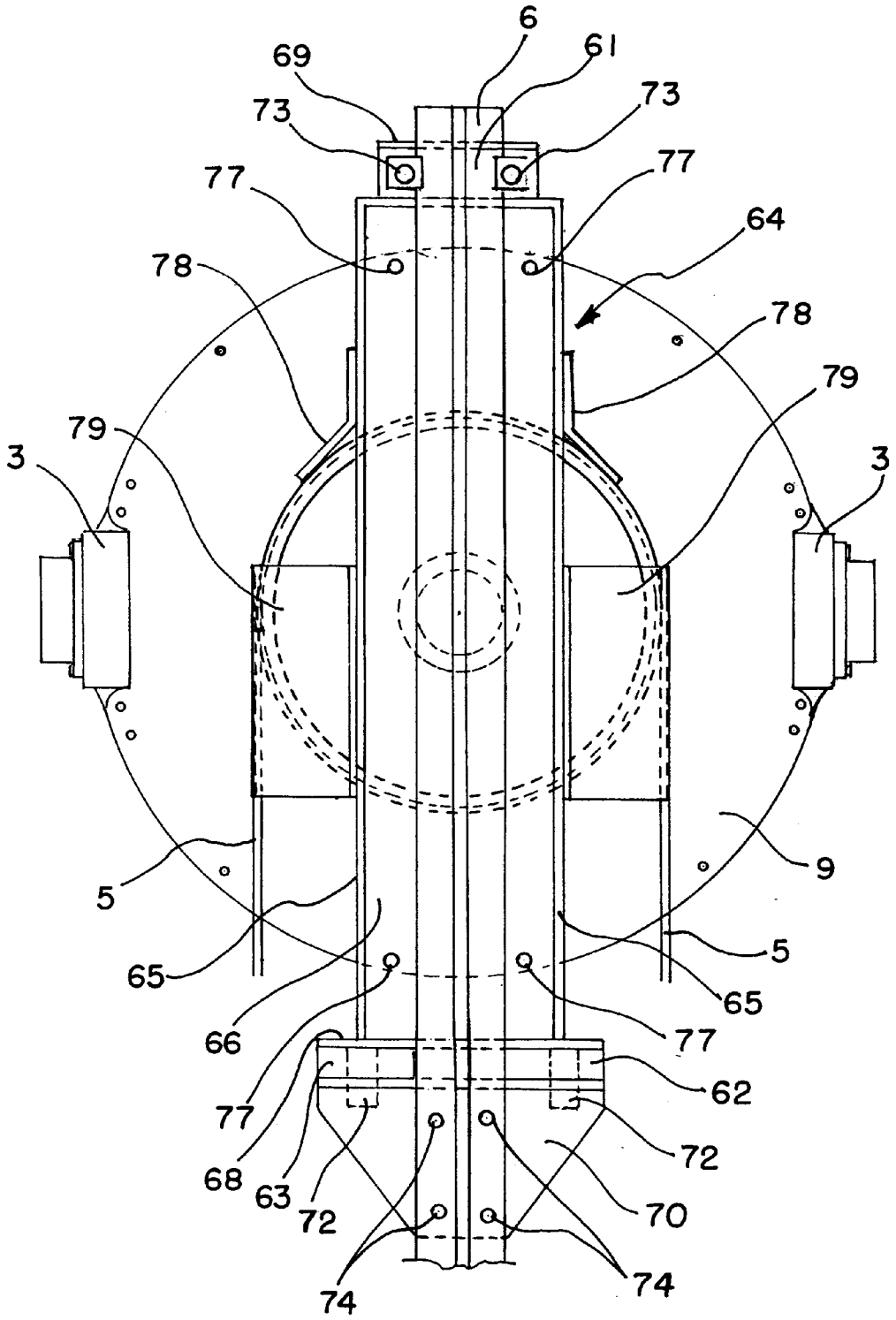
FIG. 6 illustrates the vibration damping system of the elevator machinery.
Figure 7:
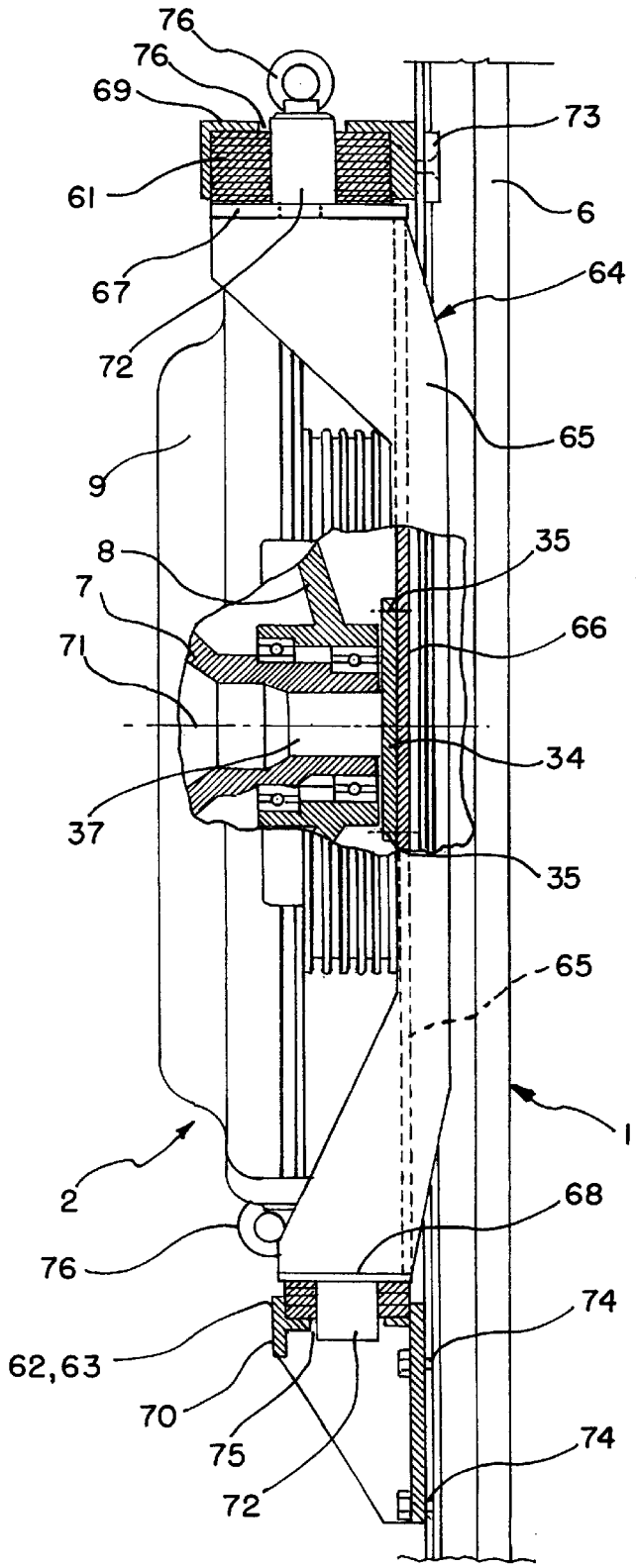
FIG. 7 presents the vibration damping elements in a cross-section of the elevator machinery.

FIGS. 6 and 7 present an application of the vibration damping system in an elevator machinery 1 as defined by the invention, the machinery being mounted on the rail 6 by means of an auxiliary frame 64.

The auxiliary frame 64 consists of a base plate 66, two side plates 65, a top end plate 67 and a bottom end plate 68, said plates being joined together. The side plates are reinforcing plates extending through about one half of the rail height past the T-back towards the guide surface. This solution enables a small total thickness of the machinery to be achieved. The vibration damping elements 61, 62 and 63 between the elevator machinery 1 and the guide rail 6 are attached to the stator 9 and the guide rail 6 via the auxiliary frame 64 in such manner that the auxiliary frame 64 is fixed to the stator 9 and the damping elements 61, 62 and 63 are between the guide rail 6 and the auxiliary frame 64. In principle, it would be possible to use only one damping element, but technically and economically it is advantageous to divide damping element into smaller parts, preferably three parts, a first 62, a second 62 and a third damper 63. Two dampers 62 and 63 prevent the elevator machinery 1 from substantially turning about the longitudinal axis of the guide rail 6, and similarly two dampers, the first 61 and second 62 and/or the first 61 and third 63 dampers, prevent the elevator machinery 1 from substantially deviating vertically from the direction of the guide rail 6. The first damper 61 at the top edge of the machinery is held between the top end plate 67 and a top cover 69, said top cover being attached to the guide rail 6 by means of a fixing element 73. Correspondingly, the second and third dampers 62 and 63 placed side by side below the machinery are held between the auxiliary frame 64 and a lower supporter 70. The lower supporter is attached to the guide rail 6 by means of fixing elements 74. The top cover 69 and the lower supporter 70 are provided with a fillet to prevent sideways movement of the dampers. The shear forces resisting the rotation and rolling over of the machinery are transmitted by guide pins 72 fixed to the auxiliary frame 64 and passing through the dampers. The auxiliary frame 64 also acts as a structural part increasing the rigidity of the stator 9, the auxiliary frame being attached to the stator 9 at a point in its central part in the region of the shaft 7 by means of the supporting element 34 and fixing screws 35 and at two points on the edge of the stator by means of fixing elements 77. One of the hoisting lugs 76 of the machinery is attached to the guide pin 72 going through the first damper 61. The guide pins 72 are passed through holes 75 in the top and bottom end plates. The guide pins act as safety devices after the occurrence of a possible damper breakage, because in that case the guide pin will remain leaning against the top or bottom end plate.

An alternative way of mounting the dampers is to place each damper between two cuplike structures. The upper cup would have a diameter slightly larger than that of the lower cup and would partly surround the lower cup. In the event of a damper breakage, the cup edges would come into contact with each other, thus preventing the elevator machinery from coming off the auxiliary frame.

It is obvious to a person skilled in the art that different embodiments of the invention are not restricted to the examples described above, but that they may instead be varied within the scope of the claims presented below. Such variations are not to be regarded as a departure from the spirit and scope of the invention, and all such modifications as would be obvious to one skilled in the art are intended to be included within the scope of the following claims.

We claim:

1. A drive machinery for an elevator, said elevator including a counterweight and elevator ropes, said machinery comprising an elevator motor, a traction sheave driving the elevator ropes, and a guide for at least one of the elevator and counterweight, the guide extending in a longitudinal direction which is a same direction as a direction of travel of the counterweight, the guide having a longitudinal side, said elevator motor having a stator, a rotor, a motor shaft and at least one bearing between the rotor and the stator, the elevator motor being mounted on the longitudinal side of the guide.

2. The drive machinery as defined in claim 1, wherein the elevator motor is structurally reinforced by the guide.

3. The drive machinery as defined in claim 1, wherein the at least one bearing has a rolling center and wherein vertical forces from the elevator ropes are passed via the rolling center of the at least one bearing to the guide.

4. The drive machinery as defined in claim 1, further comprising a supporting element between the elevator motor and the guide for supporting the elevator motor.

5. The drive machinery as defined in claim 4, wherein the at least one bearing has a rolling center and wherein the supporting element has a supporting center which is generally vertically aligned with the rolling center of the at least one bearing.

6. The drive machinery as defined in claim 1, further comprising at least one vibration damping element between the elevator motor and the guide.

7. The drive machinery as defined in claim 6, wherein the damping element is placed between the stator of the elevator motor and the guide.

8. The drive machinery as defined in claim 1, further comprising at least one vibration damping element between the elevator motor and the guide, the machinery further comprising an auxiliary frame, the damping element being attached to the stator and the guide via the auxiliary frame in such a manner that the auxiliary frame is attached to the stator, and the damping element being between the auxiliary frame and the guide.

9. The drive machinery as defined in claim 8, wherein the damping element is divided into a first damper, a second damper and a third damper, at least two dampers preventing the elevator motor from substantially turning about a longitudinal axis of the guide, and at least two dampers preventing the elevator motor from substantially deviating vertically.

10. The drive machinery as defined in claim 8, wherein the auxiliary frame increases rigidity of the stator, the shaft having a central region and the stator having a plurality of connection points on an edge thereof, the auxiliary frame being attached to the stator at the central region of the shaft and at the plurality of connection points on an edge of the stator.

11. The drive machinery as defined in claim 8, further comprising fixing elements for attaching the auxiliary frame to the stator.

12. The drive machinery of claim 1, wherein the guide is a guide rail.

13. The drive machinery as defined in claim 1, further comprising an elevator car and wherein the guide on which the elevator motor is mounted extends in a same direction as a travel direction of the elevator car.

14. The drive machinery as defined in claim 1, wherein the motor is a discoidal motor with the stator being a discoidal stator and the rotor being a discoidal rotor.

15. The drive machinery as defined in claim 14, wherein the discoidal rotor is between the discoidal stator and traction sheave.

16. A drive machinery for an elevator, said elevator including a counterweight and elevator ropes, said machinery comprising an elevator motor, a traction sheave driving the elevator ropes and a guide for at least one of the elevator and counterweight, the guide having a top and bottom and, said elevator motor having a stator, a rotor, a motor shaft and at least one bearing between the rotor and the stator, the elevator motor being mounted on said guide below the top thereof.

17. The drive machinery as defined in claim 16, wherein the elevator motor is structurally reinforced by the guide.

18. The drive machinery as defined in claim 16, wherein the at least one bearing has a rolling center and wherein vertical forces from the elevator ropes are passed via the rolling center of the at least one bearing to the guide.

19. The drive machinery as defined in claim 16, further comprising a supporting element between the elevator motor and the guide for supporting the elevator motor.

20. The drive machinery as defined in claim 19, wherein the at least one bearing has a rolling center and wherein the supporting element has a supporting center which is generally vertically aligned with the rolling center of the at least one bearing.

21. The drive machinery as defined in claim 16, further comprising at least one vibration damping element between the elevator motor and the guide.

22. The drive machinery as defined in claim 21, wherein the damping element is placed between the stator of the elevator motor and the guide.

23. The drive machinery as defined in claim 16, further comprising at least one vibration damping element between the elevator motor and the guide, the machinery further comprising an auxiliary frame, the damping element being attached to the stator and the guide via the auxiliary frame in such a manner that the auxiliary frame is attached to the stator, and the damping element being between the auxiliary frame and the guide.

24. The drive machinery as defined in claim 23, wherein the damping element is divided into a first damper, a second damper and a third damper, at least two dampers preventing the elevator motor from substantially turning about a longitudinal axis of the guide, and at least two dampers preventing the elevator motor from substantially deviating vertically.

25. The drive machinery as defined in claim 23, wherein the auxiliary frame increases rigidity of the stator, the shaft having a central region and the stator having a plurality of connection points on an edge thereof, the auxiliary frame being attached to the stator at the central region of the shaft and at the plurality of connection points on an edge of the stator.

26. The drive machinery as defined in claim 25, further comprising fixing elements for attaching the auxiliary frame to the stator.

27. The drive machinery as defined in claim 16, further comprising an elevator car and wherein the guide on which the elevator motor is mounted extends in a same direction as a travel direction of the elevator car.

28. The drive machinery as defined in claim 16, wherein the guide extends in a longitudinal direction which is a same direction as a direction of travel of the counterweight, the guide having a longitudinal side and the motor being mounted on the longitudinal side of the guide.

29. The drive machinery as defined in claim 16, wherein the stator is a discoidal stator and the rotor is a discoidal rotor.

30. The drive machinery as defined in claim 29, wherein the discoidal rotor is between the discoidal stator and traction sheave.

31. The drive machinery of claim 16, wherein the guide is a guide rail.

32. A drive machinery for an elevator, said elevator including a counterweight and elevator ropes, said machinery comprising an elevator motor, a traction sheave driving the elevator ropes and a guide for at least one of the elevator and counterweight, the guide having a top end and a bottom end, said elevator motor having a stator, a rotor, a motor shaft and at least one bearing between the rotor and the stator, the elevator motor being mounted on the guide between the ends thereof.

33. The drive machinery as defined in claim 32, wherein the elevator motor is structurally reinforced by the guide.

34. The drive machinery as defined in claim 32, wherein the at least one bearing has a rolling center and wherein vertical forces from the elevator ropes are passed via the rolling center of the at least one bearing to the guide.

35. The drive machinery as defined in claim 32, further comprising a supporting element between the elevator motor and the guide for supporting the elevator motor.

36. The drive machinery as defined in claim 35, wherein the at least one bearing has a rolling center and wherein the supporting element has a supporting center which is generally vertically aligned with the rolling center of the at least one bearing.

37. The drive machinery as defined in claim 32, further comprising at least one vibration damping element between the elevator motor and the guide.

38. The drive machinery as defined in claim 37, wherein the damping element is placed between the stator of the elevator motor and the guide.

39. The drive machinery as defined in claim 32, further comprising at least one vibration damping element between the elevator motor and the guide, the machinery further comprising an auxiliary frame, the damping element being attached to the stator and the guide via the auxiliary frame in such a manner that the auxiliary frame is attached to the stator, and the damping element being between the auxiliary frame and the guide.

40. The drive machinery as defined in claim 39, wherein the damping element is divided into a first damper, a second damper and a third damper, at least two dampers preventing the elevator motor from substantially turning about a longitudinal axis of the guide, and at least two dampers preventing the elevator motor from substantially deviating vertically.

41. The drive machinery as defined in claim 39, wherein the auxiliary frame increases rigidity of the stator, the shaft having a central region and the stator having a plurality of connection points on an edge thereof, the auxiliary frame being attached to the stator at the central region of the shaft and at the plurality of points on an edge of the stator.

42. The drive machinery as defined in claim 41, further comprising fixing elements for attaching the auxiliary frame to the stator.

43. The drive machinery as defined in claim 32, further comprising an elevator car and wherein the guide on which the elevator motor is mounted extends in a same direction as a travel direction of the elevator car.

44. The drive machinery as defined in claim 32, wherein the stator is a discoidal stator and the rotor is a discoidal rotor.

45. The drive machinery as defined in claim 44, wherein the discoidal rotor is between the discoidal stator and traction sheave.

46. A drive machinery for an elevator, said elevator including a counterweight and elevator ropes, said machinery comprising:

a guide for at least one of the elevator and counterweight;

an elevator motor and a traction sheave driving the elevator ropes, said elevator motor having a stator, a rotor, a motor shaft and at least one bearing between the rotor and the stator, the elevator motor being mounted on the guide;

at least one vibration damping element between the elevator motor and the guide; and an auxiliary frame, the damping element being attached to the stator and the guide via the auxiliary frame in such a manner that the auxiliary frame is attached to the stator, and the damping element is placed between the auxiliary frame and the guide.

47. The drive machinery as defined in claim 46, wherein the elevator motor is structurally reinforced by the guide.

48. The drive machinery as defined in claim 46, wherein the at least one bearing has a rolling center and wherein vertical forces from the elevator ropes are passed via the rolling center of the at least one bearing to the guide.

49. The drive machinery as defined in claim 46, further comprising a supporting element between the elevator motor and the guide for supporting the elevator motor.

50. The drive machinery as defined in claim 49, wherein the at least one bearing has a rolling center and wherein the supporting element has a supporting center which is generally vertically aligned with the rolling center of the at least one bearing.

51. The drive machinery as defined in claim 46, wherein the damping element is divided into a first damper, a second damper and a third damper, at least two dampers preventing the elevator motor from substantially turning about a longitudinal axis of the guide, and at least two dampers preventing the elevator motor from substantially deviating vertically.

52. The drive machinery as defined in claim 46, wherein the auxiliary frame increases rigidity of the stator, the shaft having a central region and the stator having a plurality of connection points on an edge thereof, the auxiliary frame being attached to the stator at the central region of the shaft and at the plurality of points on an edge of the stator.

53. The drive machinery as defined in claim 52, further comprising fixing elements for attaching the auxiliary frame to the stator.

54. The drive machinery of claim 46, wherein the guide is a guide rail.

55. The drive machinery as defined in claim 46, wherein the rotor is between the stator and traction sheave.

56. The drive machinery as defined in claim 46, further comprising an elevator car and wherein the guide on which the elevator motor is mounted extends in a same direction as a travel direction of the elevator car.

57. The drive machinery as defined in claim 46, wherein the stator is a discoidal stator and the rotor is a discoidal rotor.

58. A gearless traction sheave drive assembly for an elevator, said elevator including a counterweight, an elevator car and elevator ropes, the elevator ropes extending between at least the counterweight and the elevator car, said drive assembly comprising:

a motor having a sheave for driving the elevator ropes; and a guide for at least one of the elevator and counterweight which move along the guide, the motor being attached to the guide with the guide having a guiding surface, the guide extending laterally from the motor towards the guiding surface.

59. The drive assembly as defined in claim 58, wherein the guide has a top and bottom and wherein the motor is mounted on the guide below the top thereof.

60. The drive assembly as defined in claim 58, wherein the guide has a top and a bottom and wherein the motor is mounted on the guide between the top and bottom thereof.

61. The drive assembly as defined in claim 58, wherein the motor is structurally reinforced by the guide.

62. The drive assembly as defined in claim 58, wherein the motor includes a discoidal stator and a discoidal rotor.

63. The drive assembly as defined in claim 62, wherein the motor further comprises at least one bearing between the discoidal rotor and the discoidal stator and wherein the at least one bearing has a rolling center and wherein vertical forces from the elevator ropes are passed via the rolling center of the at least one bearing to the guide.

64. The drive assembly as defined in claim 63, further comprising a supporting element between the motor and the guide for supporting the motor, the supporting element having a supporting center which is generally vertically aligned with the rolling center of the at least one bearing.

65. The drive assembly as defined in claim 58, further comprising at least one vibration damping element between the motor and the guide.

66. The drive assembly as defined in claim 65, further comprising an auxiliary frame, the damping element being attached to the stator and the guide via the auxiliary frame in such a manner that the auxiliary frame is attached to the stator, and the damping element being between the auxiliary frame and the guide.

67. The drive assembly as defined in claim 66, wherein the damping element is divided into a first damper, a second damper and a third damper, at least two dampers preventing the motor from substantially turning about a longitudinal axis of the guide, and at least two dampers preventing the motor from substantially deviating vertically.

68. The drive assembly as defined in claim 65, wherein the motor has a shaft and wherein the auxiliary frame increases rigidity of the stator, the shaft having a central region and the stator having a plurality of connection points on an edge thereof, the auxiliary frame being attached to the stator at the central region of the shaft and at the plurality of connection points on an edge of the stator.

69. The drive assembly as defined in claim 58, wherein the motor has a stator with a given diameter and a rotor with a given diameter, and wherein the sheave is of a diameter no greater than the diameter of at least one of the stator and the rotor.

70. The drive assembly as defined in claim 58, wherein the guide is a guide rail.

71. The drive machinery as defined in claim 62, wherein the discoidal rotor is between the discoidal stator and sheave.

72. The drive machinery as defined in claim 58, wherein the guide on which the elevator motor is attached extends in a same direction as a travel direction of the elevator car.

73. The drive machinery of claim 32, wherein the guide is a guide rail.

74. The drive machinery as defined in claim 32, wherein the guide extends in a longitudinal direction which is a same direction as a direction of travel of the counterweight, the guide having a longitudinal side and the motor being mounted on the longitudinal side of the guide.

75. A gearless traction sheave drive assembly for an elevator, said elevator including a counterweight, an elevator car and elevator ropes, the elevator ropes extending between at least the counterweight and the elevator car, said drive assembly comprising:

a motor having a sheave for driving the elevator ropes; and a guide for at least one of the elevator and counterweight which move along a longitudinal side of the guide, the motor being attached to the longitudinal side of the guide with the guide being between the elevator car and the counterweight.

76. The drive assembly as defined in claim 75, wherein the guide has a top and bottom and wherein the motor is mounted on the guide below the top thereof.

77. The drive assembly as defined in claim 75, wherein the guide has a top and a bottom and wherein the motor is mounted on the guide between the top and bottom thereof.

78. The drive assembly as defined in claim 75, wherein the motor includes a discoidal stator and a discoidal rotor.

79. The drive assembly as defined in claim 75, wherein the motor further comprises at least one bearing between the discoidal rotor and the discoidal stator and wherein the at least one bearing has a rolling center and wherein vertical forces from the elevator ropes are passed via the rolling center of the at least one bearing to the guide.

80. The drive assembly as defined in claim 79, further comprising a supporting element between the motor and the guide for supporting the motor, the supporting element having a supporting center which is generally vertically aligned with the rolling center of the at least one bearing.

81. The drive assembly as defined in claim 75, wherein the motor has a stator with a given diameter and a rotor with a given diameter, and wherein the sheave is of a diameter no greater than the diameter of at least one of the stator and the rotor.

82. The drive assembly as defined in claim 75, wherein the guide is a guide rail.

* * * * *